United States Patent [19]

Kelner

[11] Patent Number: 4,702,374

[45] Date of Patent: Oct. 27, 1987

[54] PACKAGE ASSEMBLY WITH TESTING FEATURE FOR ILLUMINATED PRODUCT

[76] Inventor: Robert Kelner, 4101 NW. 132 St., Miami, Fla. 33054

[21] Appl. No.: 854,387

[22] Filed: Apr. 21, 1986

[51] Int. Cl.[4] ..... B65D 85/42

[52] U.S. Cl. ..... 206/418; 206/45.14; 206/45.31; 206/462; 206/471; 206/488

[58] Field of Search ..... 206/45.31, 45.33, 573, 206/418, 419, 461, 462, 463, 466, 468, 471, 806, 473, 488, 329, 332, 334, 320, 443, 446, 576, 45.14; 362/810; D9/415; 40/540, 152.2, 153

[56] References Cited

U.S. PATENT DOCUMENTS

| | | | |
|---|---|---|---|
| D. 285,121 | 8/1986 | Schwartz | D9/415 X |
| 1,784,937 | 12/1930 | Kreslawsky | 40/540 |
| 3,289,830 | 12/1966 | Foote | 206/462 X |
| 3,878,941 | 4/1975 | Kelner | 206/419 |
| 3,939,979 | 2/1976 | Neumayer | 206/461 |
| 4,468,721 | 8/1984 | Vandrilla | 362/810 X |
| 4,624,117 | 11/1986 | Ory et al. | 206/320 X |

*Primary Examiner*—George E. Lowrance
*Assistant Examiner*—Bryon Gehman
*Attorney, Agent, or Firm*—John Cyril Malloy

[57] ABSTRACT

A package assembly primarily designed to contain and at the same time display an illuminated product such as decorative lights, etc. wherein a conventional electric plug used to interconnect the illuminated product to a conventional power source is positioned on the interior of the package assembly immediately adjacent and in communicating relation to an access opening in one wall of the package structure wherein the access opening is dimensioned and configured to allow removal of the plug for connection to a wall outlet thereby allowing testing of the illuminated product without removing it from the package.

10 Claims, 6 Drawing Figures

PACKAGE ASSEMBLY WITH TESTING FEATURE FOR ILLUMINATED PRODUCT

BACKGROUND OF THE INVENTION

1. Field of the Invention

A package assembly is provided with a transparent wall structure disposed in covering or overlying relation to a product capable of being illuminated, such as decorative lights or the like, enabling the product to be clearly viewed from the exterior of the package assembly. An anchor structure removably supports and positions a conventional electric plug immediately adjacent an access opening which is dimensioned for removal of the plug only from the interior of the package. The plug may be interconnected to a wall outlet to power and illuminate the product within the package thereby testing the product without removing it from the package.

2. Description of the Prior Art

The packaging industry has progressed to the point where packages can be designed and constructed in an extremely wide variety of sizes and shapes and also formed from a variety of materials. In many cases, packaging is specifically designed to enhance the appearance of a product when placed on display for retail sale.

In addition, many packages include a transparent or transcluent material forming a portion or all of the package which surrounds a given product thereby enabling the product itself to be viewed. This enables inspection of the packaged article prior to purchase.

However, while the article may be inspected, by viewing in a cursory manner, typical packaging construction does not allow true "testing" of an article or product without removal from the package. This of course defeats the purpose of packaging since most package designs are intended for retail display and are not meant to be resealed or reclosed after once being opened. To the contrary, most retail packaging structures are meant to be permanently closed to insure that a customer is purchasing a product which has not been used or tampered with. When packaging illuminated products such as decorative lighting, it would be highly desirable to first "test" the product or at least allow the potential purchaser to view the product when illuminated. This would insure not only proper working of the illuminated product but would provide the customer with a more complete impression of how the product would look when placed in operation or illuminated.

Based on the above, there is obviously a need in the packaging industry for a package structure which completely and adequately contains and displays a product, such as utilitarian or ornamental lights, in a manner which allows the customer to view the packaged product in whole or in part. In addition, such a preferred package assembly should be capable of allowing illumination of the product by providing a structure, in the package itself, for feeding power to the article without damaging or destroying the package, and preferably, without removing the article or product from its contained and packaged position.

SUMMARY OF THE INVENTION

The present invention is directed towards a package assembly primarily designed to at least partially display an illuminated product or article, such as ornamental lights which may be electrically powered through interconnection of a conventional two prong electric plug with a wall outlet.

More particularly, the subject package assembly includes a wall structure at least a portion of which is formed from a transparent material disposed in overlying relation to the illuminated article or product and which preferably defines an exposed face of the package assembly. The position of the transparent material should be such as to allow clear visual observation of the illuminated product and more specifically, the light bulbs which are illuminated on the product itself.

The wall structure of the package assembly further comprises a base portion which preferably is of a somewhat more rigid material than said transparent portion of the wall structure so as to provide structural integrity to the package assembly. Accordingly, the product disposed on the interior of the package assembly includes one or more illuminated articles, such as a light bulb or the like, interconnected to a power source by means of a conventional insulated conductor connected at an extremity thereof to a conventional multi-pronged connector plug. The plug is of the type designed to fit in the socket of a wall outlet for interconnection to a conventional electrical power source.

An important feature of the present invention is the inclusion of access means formed in the base portion of the package assembly wherein the access means includes an access aperture. The aperture is dimensioned and configured to allow passage therethrough of the plug associated with the illuminated product but of insufficient dimension or configuration to allow passage or removal of the entire product from the interior of the package assembly. Associated with the access means is an anchor means disposed in aligned accessible relation to the access aperture. The anchor means is specifically structured to removably mount and accordingly position the connecting plug immediately adjacent and in accessible relation to the access aperture. A customer may in effect reach in, remove the plug from the interior of the package and withdraw it through the access aperture for connection to a conventional wall outlet. Accordingly, the packaged illuminated product or article will be activated or illuminated without removal from the package. The provision of a transparent material portion of the wall structure will allow viewing of at least a portion, or the entire product, while it is illuminated. Therefore, the illuminated article may be viewed in its operative state without damage or destruction of the package assembly.

After testing, the plug may of course be removed from the wall outlet and passed back through the access aperture into the interior of the package assembly and removably secured to the mounting means.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
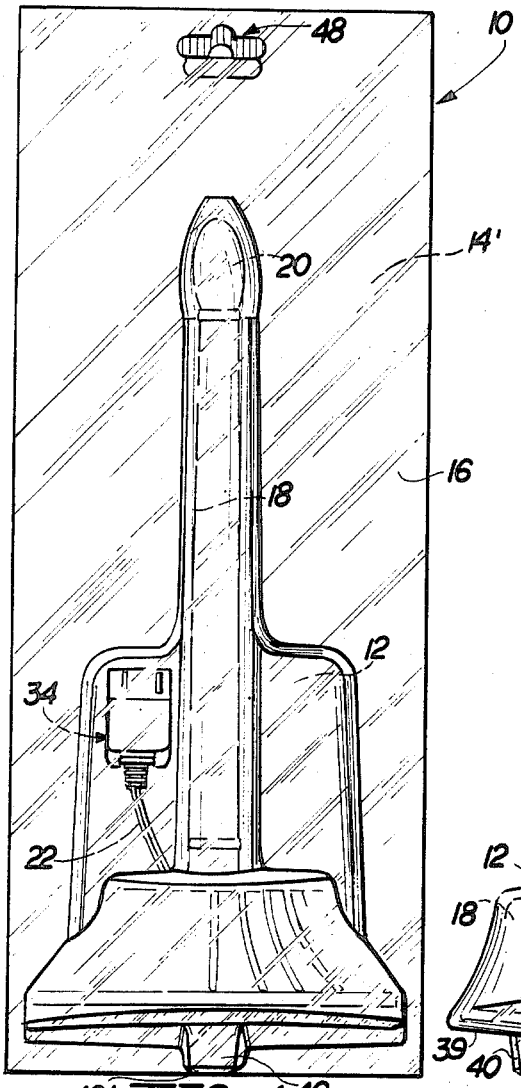
FIG. 1 is a front plan view of a preferred embodiment of the present invention.

As shown in FIG. 1, the present invention relates to a package assembly generally indicated as 10 having a hollow interior portion 12, the boundaries of which are defined by a wall structure. The wall structure may include a variety of structural configurations but in a preferred embodiment, includes a base portion 14 formed of a cardboard, paperboard or like semi-rigid material. The base portion 14 may form a support for a transparent portion 16 of the structure. The portion 16 of the wall structure is preferably formed in whole or in part from a transparent material. Accordingly, the hollow interior of the package assembly 10 as at 12 is defined between the exposed surface a at 14' and the interior surface of the second wall 16. The dimension and configuration of the two wall structures 14 and 16 as well as the hollow interior portion 12 may of course vary dependent upon the intended article or product 18 being packaged.

More particularly, the article 18 may be termed an illuminated product or article including one or more illuminated elements 20 in the form of a light bulb or other structure capable of being illuminated when electrically powered. As clearly shown in FIGS. 1 and 2, the transparent portion of the wall structure as at 16 is disposed in overlying or at least partially enclosing relation to the product 18 as well as the individual illuminated element 20 such that clear visual observation by a customer is possible.

The packaged product 18, as set forth above, is powered by electricity and accordingly includes a conventional insulated electrical conductor 22 connected at its distal extremity to a connector plug 24 having a plurality of prongs 26. The connector plug 24 thereby is designed to be removably secured to a wall outlet for interconnection to a conventional a.c. power source or the like.

Figure 2:
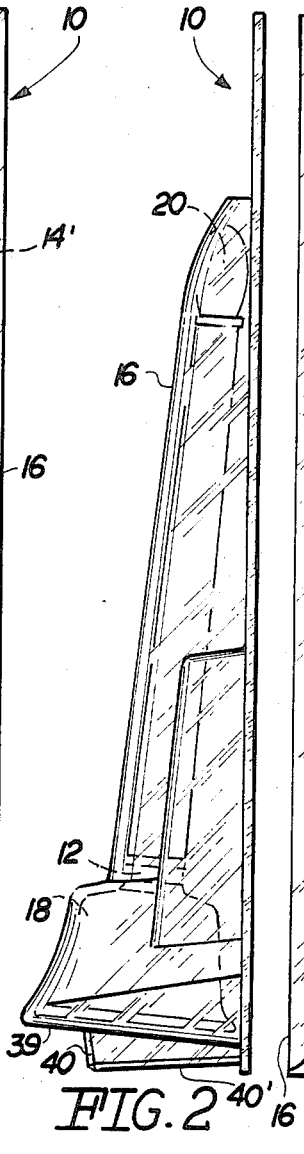
FIG. 2 is a longitudinal side view of the embodiment of FIG. 1.
Figure 3:
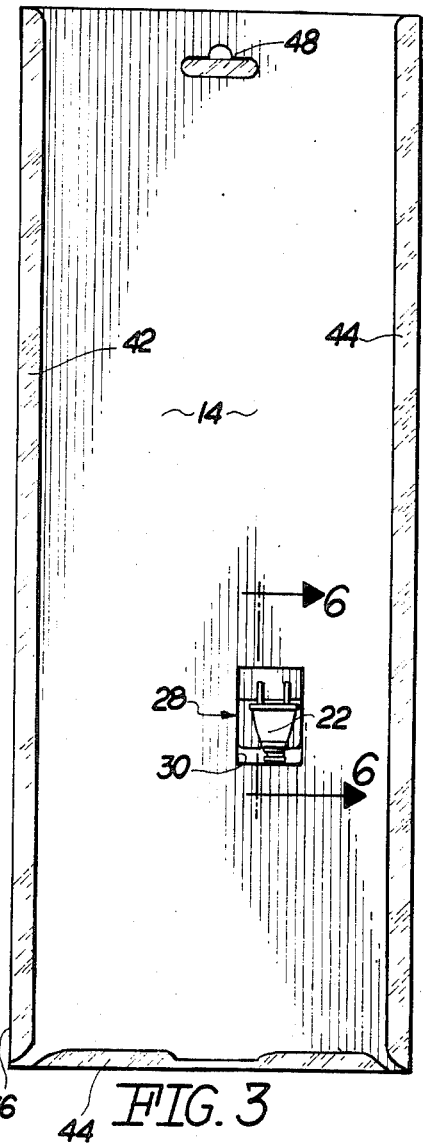
FIG. 3 is a rear view showing certain structures of an access opening and anchor structure for a conventional electric plug.

An important feature of the present invention is the provision of an access means generally indicated as 28 and including an access aperture 30 integrally formed in the wall structure and in the preferred embodiments shown in FIGS. 1 through 3 in the first wall 14. The access aperture 30 is specifically dimensioned and configured to allow connecting plug 24 to pass therethrough in a direction both into and out of hollow interior portion 12 of the package assembly 10. However, the dimension and configuration of access aperture 30 is such as to prevent passage therethrough or removal of the article 18 from the interior 12 of the package assembly 10.

Figure 4:
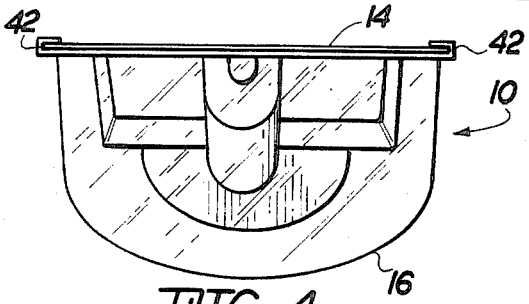
FIG. 4 is a top plan view of the embodiment of FIG. 1.
Figure 5:
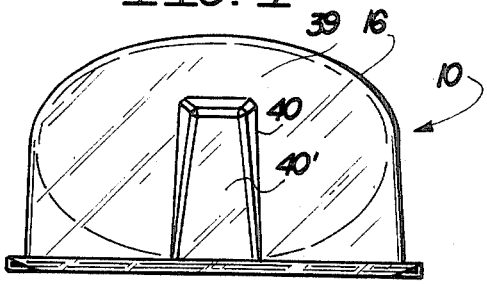
FIG. 5 is a bottom plan view of the embodiment of FIG. 1.
Figure 6:
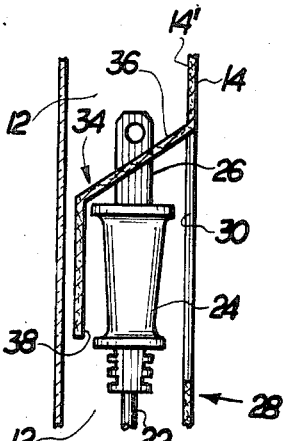
FIG. 6 is a sectional view in partial cutaway along line 6—6 of FIG. 3.

In order to insure access to the connector plug 14, an anchor means generally incidated as 34 is positioned on the interior 12 of the package and is specifically structured to removably engage and support the connector plug 24 in aligned accessible relation to the access aperture 30. More specifically, the anchor means 34 comprises an inwardly projecting tongue element 36 which is slotted (see FIGS. 1 and 6) to receive the prong 26 of the connector plug 24 therein. In addition, the tongue 36 may have an extension as at 38 which may normally engage and rest against the interior surface of the second wall 16 or be spaced thereform as shown in FIG. 6. This provides some stability to the placement of the tongue 36 and facilitate placement of the connector plug 24 and more specifically, the prongs 26 in its mounted but removable position as clearly shown in FIGS. 3 and 6. In addition, the length of the depending extension 38 is such as to substantially cover the majority of the body of plug 24 so as to facilitate blending in of the appearance and a somewhat hiding of the plug 24. Such hiding of the plug 24 is further facilitated when the exterior surface of the extension 38 and tongue 36 blends in or has the same pictorial design as the exterior surface 14'. Accordingly, one viewing the package when in its upright position as shown in FIGS. 1, 2 and 4 would be less likely to notice the positioning of the plug 24 in the manner shown in FIGS. 1 an 6 when the design or pictorial representations on surface 14' and the outer surfaces of tongue 36 and extension 38 are substantially identical.

Removal of plug 24 from the interior 12 of package assembly 10 is accomplished by placing one's finger through the access aperture 30 into gripping engagement with the plug 24 and removing the plug therethrough.

It should be readily apparent therefore that the plug 24 can be removed and connected to a conventional wall socket such that electrical current is fed to the device 18 thereby illuminating one or more bulbs 20. The potential customer can then clearly view all or part of the device 18 through second wall structure 16 and thereby view the appearance of the article 18 when current is supplied thereto.

Further structural features of the subject package assembly includes the provision of one or more depending, outwardly extending foot structures 40 disposed beneath the outer projection 39 and having a lower edge 40' substantially positioned in corresponding relation to a supporting surface on which the package assembly 10 may be positioned. The provision of the foot structure 40 (or a plurality thereof) is to position and maintain the package in a substantially vertical upright position for more effecient and effective display of the illuminated article 18 maintained on the interior 12 of the package assembly 10.

In addition, removal of the base 14 from the transparent wall structure portion 16 may be accomplished without destruction of the package merely by "sliding" the base 14 out of a track structure defined by extended and folded peripheral flanges 42 and 44 as best shown in FIGS. 3 and 4. As should be clearly apparent, the flanges 42 and 44 are integrally formed to the transparent exposed wall structure 16 but are bent thereabout so as to at least partially surround the longitudinal peripheral edges of the base (flanges 42) and the bottom peripheral edge by flange 44. Removal of the base 14 from the remainder of the wall structure 16 occurs by first removing the plug 24 and prongs 26 from the anchor means 34 and then merely sliding or lifting the base 14 out of the peripheral engagement with the flanges 42 and 44.

Yet other structural features of the present invention include an aperture structure generally indicated as 48 which would allow the hanging of the package assembly 10 on a hook for display when it is not desired to maintain the package in an upright position.

It is therefore to be understood that the following claims are intended to cover all of the generic and specific features of the present invention herein described, and all statements of the scope of the invention which as a matter of language, might be said to fall therebetween.

Now that the invention has been described, what is claimed is:

1. In a package assembly including a hollow interior portion at least partially defined by a surrounding wall structure and being of the type primarily designed to contain an illumination device on the interior thereof and display the illumination device for retail sale, the illumination device being electrically powered and connectable to an electric power source by a connecting plug, an improvement comprising:

(a) said wall structure comprising a transparent portion disposed in overlying relation to the illumination device and a base portion connected to said transparent portion, (b) said transparent portion removably attached to said base portion and cooperatively configured therewith to define boundaries of said hollow interior portion, (c) access means formed in said wall structure in aligned disposition with the connecting plug within said hollow interior portion, said access means comprising an access aperture formed in said wall structure in communication with said hollow interior portion and the connecting plug therein, (d) anchor means connected to said wall structure and disposed within said hollow interior portion for secured positioning of the connecting plug within said hollow interior portion, (e) said anchor means comprising a tongue element secured to said base portion and extending outwardly therefrom adjacent said access aperture and into said hollow interior portion, (f) said tongue element including a sufficient longitudinal dimension to support and extend beyond the connector plug in substantially covering relation to one side of the plug, the connector plug being substantially hidden when viewing said hollow interior portion through said transparent wall portion, (g) said acess aperture disposed to allow passage of the connector plug therethrough from said hollow interior portion and into connection with an electrical power source, and (h) said transparent portion cooperatively disposed with said illumination device for viewing of said illumination device therethrough when the connecting plug is connected to the electrical power source.

2. An assembly as in claim 1 wherein said tongue element is secured to said base portion contiguous to a periphery of said access opening and disposed out of coplanar relation with said base portion into engageable relation with an inner surface of said transparent portion, said tongue element maintained in an adjacent, accessible relation to said access aperture while contacting said transparent portion.

3. An assembly as in claim 1 wherein said tongue element is structured for removable support of said connecting plug within said hollow interior portion.

4. An assembly as in claim 1 wherein said access aperture is dimensioned at least minimally greater than the connecting plug and configured to allow passage thereof through said access aperture.

5. An assembly as in claim 4 wherein said access aperture is of insufficient size and dimension to allow passage therethrough of a majority of the remainder of the illumination device.

6. An assembly as in claim 1 wherein said access aperture is integrally formed in said base portion and is dimensioned at least minimally greater than the connecting plug and configured to allow passage thereof through said access aperture, said access aperture being of insufficient size and dimension to allow passage therethrough of a majority of the remainder of the illumination device.

7. An assembly as in claim 1 further comprising a support means for maintaining the package assembly in a substantially upright orientation and comprising a foot structure integrally secured to said wall structure in an outwardly protruding relation to a lower end of said package assembly, said foot structure disposed and dimensioned to engage a supporting surface on which said package assembly rests.

8. An assembly as in claim 7 wherein said foot tructure comprises at least one protrusion integrally formed in said transparent portion and extending outwardly from a lower end thereof into supporting engagement with a supporting surface.

9. An assembly as in claim 1 wherein said base portion comprises a periphery thereof slidably engaging a corresponding periphery of said transparent portion, said respective peripheries cooperatively structured and configured for removable retention of said base portion by said transparent portion.

10. An assembly as in claim 9 wherein said periphery of said transparent portion is disposed in a substantially closing relation to at least oppositely disposed peripheral edges of said base portion, said peripheral edges slidably disposed within said periphery of said transparent portion for removal of said base portion relative to said transparent portion.

* * * * *